US005422664A

United States Patent [19]

Stephany

[11] Patent Number: 5,422,664

[45] Date of Patent: Jun. 6, 1995

[54] METHOD AND APPARATUS FOR MAINTAINING CONSTANT DROP SIZE MASS IN THERMAL INK JET PRINTERS

[75] Inventor: Joseph F. Stephany, Williamson, N.Y.

[73] Assignee: Xerox Corporation, Stamford, Conn.

[21] Appl. No.: 81,898

[22] Filed: Jun. 25, 1993

[51] Int. Cl.[6] ..... B41J 2/05

[52] U.S. Cl. ..... 347/14; 347/19

[58] Field of Search ..... 347/14, 19

[56] References Cited

U.S. PATENT DOCUMENTS

| | | | |
|---|---|---|---|
| 4,323,905 | 4/1982 | Reitberger | 347/6 |
| 4,788,466 | 11/1988 | Paul et al. | 310/316 |
| 4,835,435 | 5/1989 | Yeung | 347/6 |
| 4,872,028 | 10/1989 | Lloyd | 347/14 |
| 5,036,337 | 7/1991 | Rezanker | 347/14 |
| 5,107,276 | 4/1992 | Kneezel et al. | 347/17 |

*Primary Examiner*—Joseph W. Hartary

[57] ABSTRACT

A Thermal ink jet printer has a rotatable platen with an oscillator circuit mounted therein which includes a resonant vibratory device on which the ink droplets ejected from the printhead nozzles by electrical pulses are received and the mass thereof are measured. A piezoelectric sensor, such as a quartz crystal, serves as an environment for measuring the mass of ink droplets deposited on the crystal face. The difference in frequency before and after drop deposition is exactly proportional to the ink drop mass. Frequency change is measured to provide a feedback signal to the printer controlled for adjustment of the droplet ejecting pulses to control the drop size.

6 Claims, 7 Drawing Sheets

OSC.
PRINTER CONTROLLER
PRINTHEAD
SHIFT REGISTER
INPUT
OUTPUT
LOAD
CLK
FREQUENCY COUNTER
INPUT
UP/DOWN
CLEAR
EPLD
LOAD
CLK
CLEAR
UP/DOWN
GATE
VOLTAGE REGULATOR
CRYSTAL CONTROLLED OSCILLATOR

METHOD AND APPARATUS FOR MAINTAINING CONSTANT DROP SIZE MASS IN THERMAL INK JET PRINTERS

BACKGROUND OF THE INVENTION

This invention relates to drop-on-demand ink jet printing systems and more particularly, to a thermal ink jet printer having a rotatable platen having circuitry mounted therein including a resonant vibratory device on which the ink droplets ejected from the printhead nozzles are received and the droplet mass measured.

Thermal ink jet printing is generally a drop-on-demand type of ink printing system which uses thermal energy to produce a vapor bubble in an ink filled channel that expels a droplet. A thermal energy generator or heating element, usually a resistor, is located in the channels near the nozzle a predetermined distance therefrom. The resistors are individually addressed with an electric pulse to momentarily vaporize the ink and form a bubble which expels an ink droplet. As the bubbles grows, the ink bulges from the nozzle and is contained by the surface tension of the ink as a meniscus. As the bubble begins to collapse, the ink in the channel between the nozzle and the bubble starts to move toward the collapsing bubble, causing a volumetric contraction of the ink at the nozzle and resulting in separation of the bulging ink as a droplet. The acceleration of the ink out of the nozzle while the bubble is growing provides the momentum and velocity of the droplet in a substantially straight line towards a recording medium, such as paper.

Thus, thermal ink jet devices operate by pulsing heating elements in contact with ink so that bubbles are nucleated, ejecting ink droplets toward the paper. It has been found during print tests that print quality is affected as the device heats up. This is because the volume of the droplet and therefore the printed spot or pixel increases as a function of printhead temperature. Through study of this problem, it has been found that both the mass and velocity of the droplet increase with device temperature, and that both the mass and velocity contribute to increase pixel size on the paper. For the carriage type ink jet printer with sufficiently high printing density, the spot size increases as the carriage traverses the page. Then, as it pauses at the end of travel and reverses direction, it cools slightly, so that the next line or swath printed on the way back has increasing pixel sizes in the opposite direction. This gives rise to light and dark bands, which are most pronounced at the edges of the paper. Similarly, other patterns of high and low density printing are degraded by undesired change in pixel size with device temperature.

U.S. Pat. No. 4,788,466 to Paul et al discloses a Q-loss compensation apparatus for a piezoelectric sensor such as a quartz crystal microbalance or other vibratory device wherein the vibration amplitude of the device is controlled by negative feedback in a manner to obviate the effect of of energy loss associated with viscous damping of a large liquid drop on the quartz crystal face serving as an environment for an experiment to measure mass deposited on the crystal. The specific apparatus includes an oscillator circuit for the vibratory device in which two similar variable gain amplifiers provide the regenerative feedback for maintaining oscillation. The negative feedback amplitude control circuit serves to maintain constant the output from the variable gain amplifier following the quartz crystal in the oscillator loop, and it thus of a near constant value equal to the product of the crystal vibration amplitude and the square root of the total gain in the oscillator loop. This results in stable operation of the quartz crystal with little influence from changing conditions such as temperature, viscosity of the fluid, evaporation of the fluid, etc., at the same time producing a linear frequency change dependent on the quantity of mass deposited on the crystal face from the liquid environment. Frequency change is measured in a conventional manner with accuracy of about one part per ten million, thereby permitting determination of minute mass amounts on the order of one nanogram.

U.S. Pat. No. 5,036,337 to Rezanka discloses a method and apparatus for controlling the volume of ink droplets ejected from thermal ink jet print heads. The electrical signals applied to heating elements for generating droplet ejecting bubbles thereon are composed of packets of electrical pulses. Each pulse and spacing there between are varied in accordance with one or more whole, clock or timing units. The number of pulses per packet and width of pulses and spacing there between are controlled in accordance with the manufacturing tolerance variations, the location of the addressed heating heating element in the printhead, the number of parallel heating elements concurrently energized, and optionally the temperature of the printhead in the vicinity of the heating elements to maintain the desired volume of the ejected droplets.

U.S. Pat. No. 5,107,276 to Kneezel et al discloses a thermal ink jet printer which has a printhead that is maintained at a substantially constant operating temperature during printing. Printing on demand is accomplished by the ejection of ink droplets from the printhead nozzles in response to energy pulses selectively applied to heating elements located in ink channels upstream from the nozzles which vaporize the ink to form temporary bubbles. To prevent printhead temperature fluctuations during printing, especially in translatable carriage printers, the heating elements not being used to eject droplets are selectively energized with energy pulses having insufficient magnitude to vaporize the ink.

SUMMARY OF THE INVENTION

It is the object of the present invention to provide an improved thermal ink jet printer which maintains a substantially constant spot size in ink droplets ejected from the printhead while printing.

It is another object of the invention to maintain the spot size of the ink droplets ejected from the printhead constant during a printing mode by periodically measuring the mass of a predetermined plurality of ink droplets between each printed copy.

In the present invention, a thermal ink jet printer with a printhead of the type having an ink supply manifold and a plurality of parallel ink channels with each channel having a nozzle and a heating element, is mounted on a translatable carriage and has a rotatable cylindrical platen. The printhead is mounted on a carriage which confronts and is reciprocatingly translated along the platen. An oscillator circuit is mounted inside the platen and includes a resonant vibratory device on which the ink droplets ejected from the printhead nozzles by electrical driving pulses selectively applied to the heating elements, are received and the mass thereof is measured. The resonant vibratory device such as a piezoelectric sensor or a quartz crystal, provides the means for measuring the mass of ink droplets deposited thereon. The difference in frequency before and after drop deposition is proportional to the droplet mass. The frequency change of the sensor is measured to provide a signal representative of the mass of the droplet and comparison of this signal to a desired value generates a comparison signal in the printer controller that adjusts the driving pulses which expel the ink droplets from the printer, so that the drop mass and therefore the droplet size is maintained constant.

A more complete understanding of the present invention can be obtained by considering the following detailed description in conjunction with the accompanying drawings, wherein like parts have the same index numerals.

BRIEF DESCRIPTION OF THE DRAWINGS

Other aspects of the present invention will become apparent as the following description proceeds and upon reference to the drawings, in which.

DESCRIPTION OF THE PREFERRED EMBODIMENT

While the present invention will hereinafter be described in connection with a preferred embodiment thereof, it is not intended to limit the invention to that embodiment. On the contrary, it is intended to cover all alternatives, modifications and equivalents that may be included within the spirit and scope of the invention as defined by the appended claims.

Figure 1:
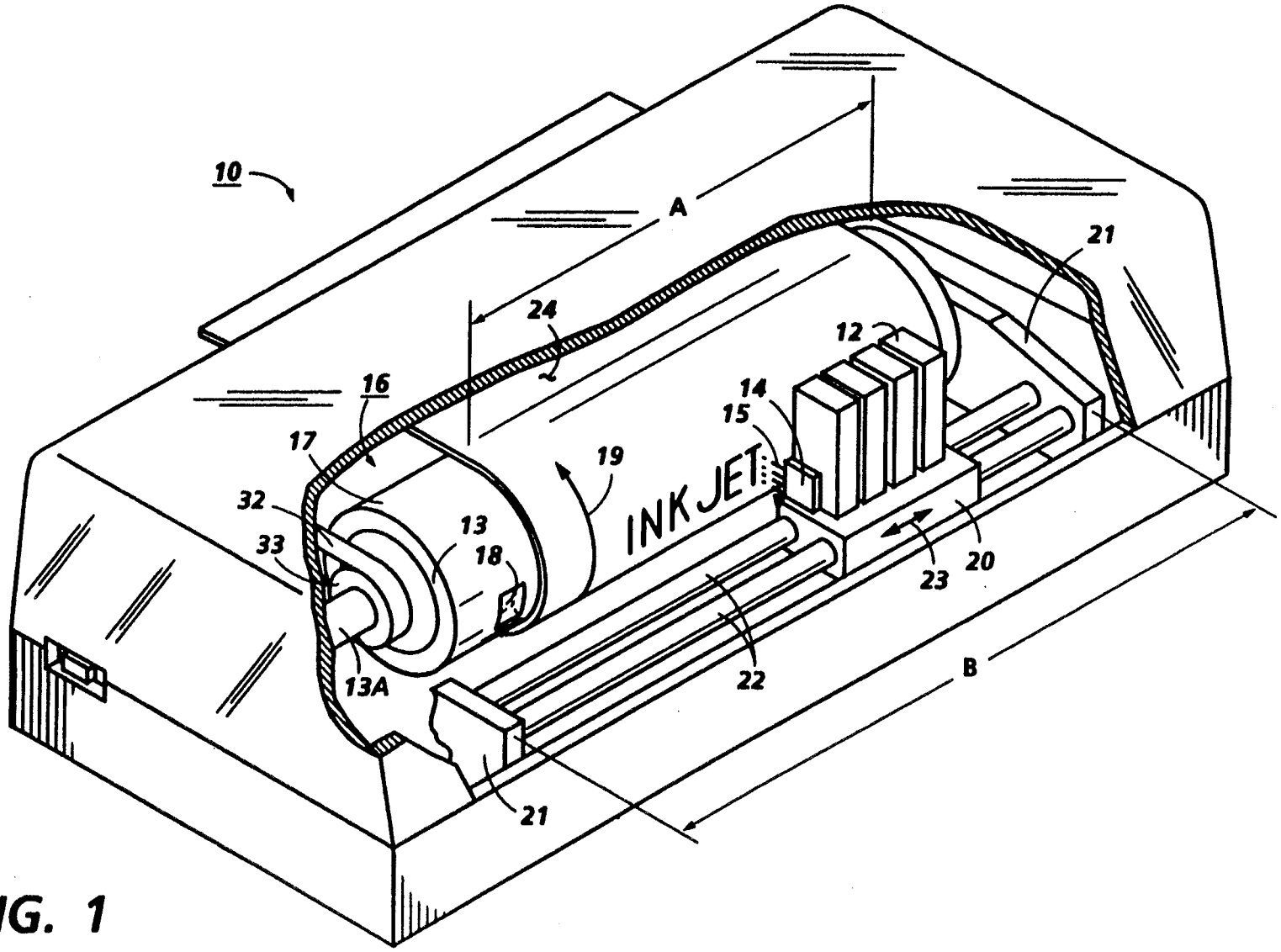
FIG. 1 is a schematic isometric view of a multi-color, carriage type, thermal ink jet printer containing the present invention and having a rotatable platen with a cavity for receiving ink droplets from printheads integrally attached to ink cartridges mounted on a translatable carriage.

In FIG. 1, a multicolor thermal ink jet printer 10 is shown containing several disposable ink supply cartridges 12, each with an integrally attached printhead 14. The ink cartridge and printhead combination are removably mounted on a translatable carriage 20. During the printing mode, the carriage reciprocates back and forth on, for example guide rails 22, parallel to the recording medium 24 as depicted by arrow 23. The end-to-end travel distance of the carriage and printheads is shown as distance B. The carriage is driven back and forth across the length of a cylindrical platen 16 by well known means such as, for example, by cable and pulley with a reversible motor (not shown). The recording medium, such as, for example, paper is mounted to platen 16. The platen has a diameter of between 10 and 20 cm and is constructed, for example, out of aluminum sleeve 17 with end caps 13 containing a shaft 13A there through which has a pulley 33 mounted on one end and driven via a stepper motor (not shown) by belt 32. The platen is rotatively mounted in frame sides 21 which also contain the ends of guide rails 22. The paper is held stationary by the platen while the carriage is moving in one direction. Prior to the carriage moving in the reverse direction, the paper is stepped by the platen in the direction of arrow 19 a distance equal to the height of the swath of data printed thereon by the printheads 14 during transversal in one direction across the paper. The width of the recording medium is the printing zone or region during the carriage transversal and is indicated as distance A. To enable printing by all of the plurality of printheads and to accommodate printhead priming and maintenance stations (not shown), the overall travel distance B is larger than the printing region A. Thus, an encoder 50 (see FIG. 6) must be used to monitor the position of the carriage 20 when the printheads are in the printing region. The droplets are ejected on demand from nozzles (not shown) located in the front faces (not shown) of the printheads along the trajectories 15 to the paper. The front face of the printhead is spaced from the paper a distance of between 0.01 and 0.1 inch, with the preferred distance being about 0.02 inches. The stepping tolerance of the platen drum 16, the paper, and the linear deviation of the printheads are held within acceptable limits to permit contiguous swaths of information to be printed without gaps or overlaps.

Figure 3:
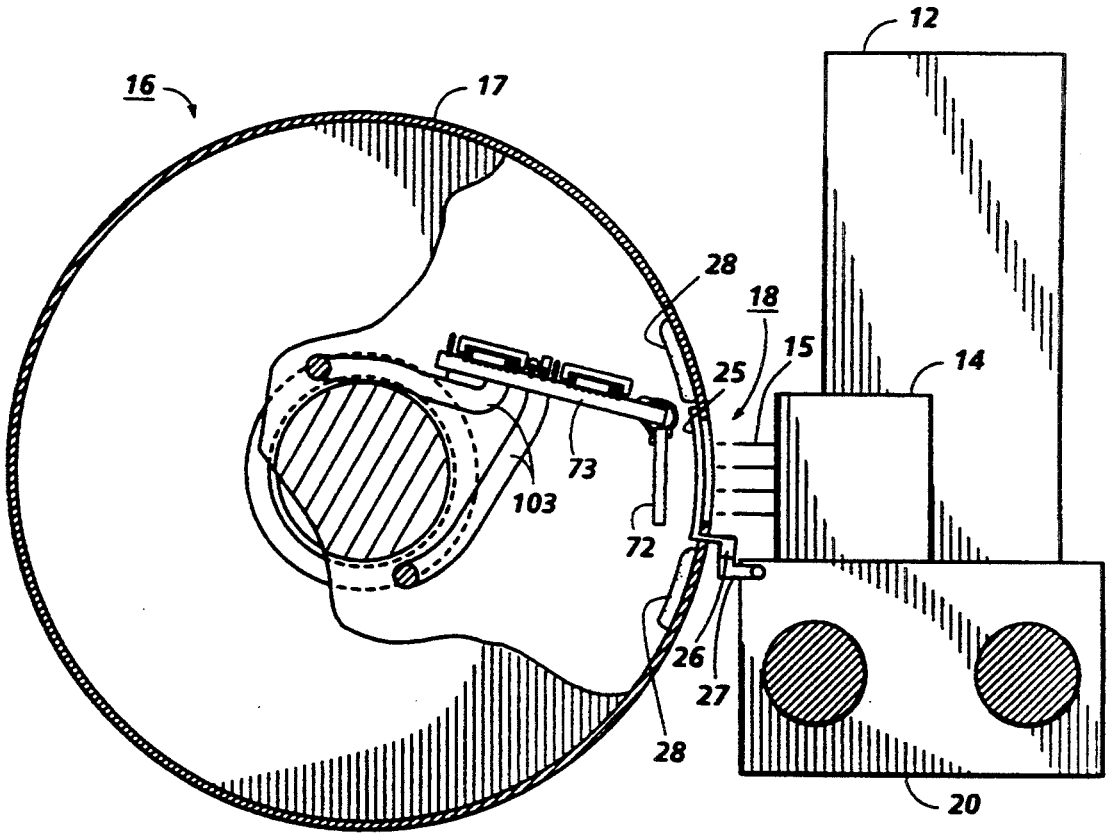
FIG. 3 Is a partially shown, enlarged schematic side view of the platen and carriage with ink cartridge of FIG. 1.

Each cartridge 12 contains a different ink, one black and one to three cartridges of different selected colors. The combined cartridge and printhead is removed and discarded after the ink supply in the cartridge has been depleted. In this environment, some of the nozzles do not eject droplets during one complete carriage traversal and generally, none of the nozzles eject droplets as the printheads move beyond the edge of the platen. While at this end of the carriage traversal, there is a small dwell time while the platen is being stepped one swath in height in the direction of arrow 19. A maintenance and priming station (not shown) is located on one side of the platen where the lesser used nozzles may fire nozzle-clearing droplets, and/or where the nozzles may be capped to prevent them from drying out during idle time when the printer is not being used. Also located on one side of the platen 16 where the maintenance and priming operations take place is a cavity 18. A spring loaded door 25, as shown in FIG. 3, is mounted over the cavity. The door is opened by a tab 27 fixed to the translatable carriage 20 indicated in FIG. 3. The door opens only as the printheads pass by whereby tab 27 pushes against a mating tab 26 located on the door 25. When the carriage travel reverses and moves away from the cavity, the door 25 correspondingly closes.

Figure 2:
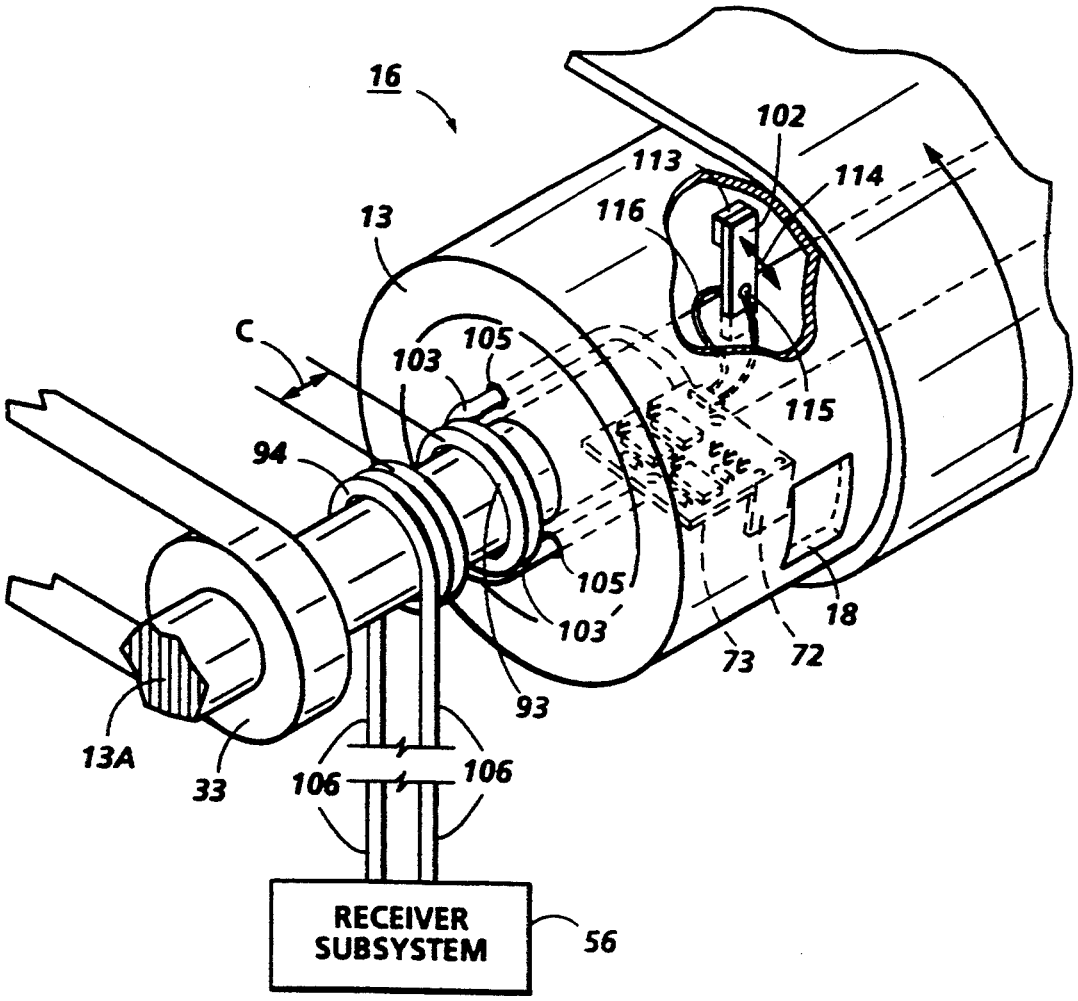
FIG. 2 is a partially shown enlarged schematic perspective view of the platen in FIG. 1 having a cavity in one end for the entry of ink droplets and having the electronic circuitry of the present invention therein aligned with the cavity for measuring the mass of ink droplets entering the cavity and deposited thereon.

Referring now to FIG. 2, a piezoelectric sensor 72 preferably in the form of an AT cut quartz crystal plate is located behind the door 25 (see FIG. 3) to form the resonant vibratory device on which the mass of the ink droplets ejected from the printhead nozzles are measured as the printheads pass by. A plurality of ink droplets are fired onto the piezoelectric sensor 72 at the start up of printing once the nominal operating temperature of the printer has been reached or during the page interspace areas between multiple page printing operations. Without a sheet of recording medium on the platen 16, the platen shaft 13A and platen are rotated at a predetermined number of revolutions per minute (RPM), so that the voltage generating piezoelectric strip 102 may be vibrated, as discussed later, to produce the required voltage to operate the mass measuring circuitry 110. The droplets are ejected into the platen opening or cavity 18 when the printheads are in alignment therewith. As the platen is rotated, the droplets are ejected in synchonism with the alignment of the revolving cavity 18 as it rotates pass the printheads, so that all of the droplets enter the platen through the cavity and land on the piezoelectric sensor 72. When a sheet of recording medium, such as paper, is being printed, the recording medium is held stationary on the platen as a swath of information is printed, then stepped a distance equal to the printed swath. The printing of swaths and stepping is continued until the entire sheet is printed.

Typically the natural mechanical resonant output of the crystal plate 72 shown in FIG. 2 is due to its mechanical vibration, which will have a frequency of approximately 10 megahertz (Mhz). The vibration is in a thickness-shear mode parallel to the crystal face so that all parts on the crystal surface will be equally sensitive to frequency change. The change in the natural mechanical frequency ($\Delta f$) is proportional to the change in mass ($\Delta M$) of the crystal plate whereby $\Delta f/f=2(\Delta M/M)$. Upon disassembling a standard crystal housing, the following parameters were obtained: mass=230 milligrams, frequency of vibration=5.5 Mhz., and crystal plate size=1.5 centimeters square. It is therefore extrapolated that a mass of 50 milligrams would result in a crystal frequency of 10 megahertz. Assuming an ink jet droplet mass of $10^{-7}$ grams, the frequency change would be approximately 20 hertz. The value for the change in frequency is compared to a table of values called a software look-up table 57 (FIG. 6) that resides in a control circuitry module 48 (FIG. 4) used to drive the printhead. If additional ink droplets are deposited on the crystal plate, the change in frequency would be proportional to the number of drops accumulated. Thus, for example, firings 10 drops would cause a change in frequency of 200 hertz, thereby increasing the accuracy of the measurement.

Figure 4:
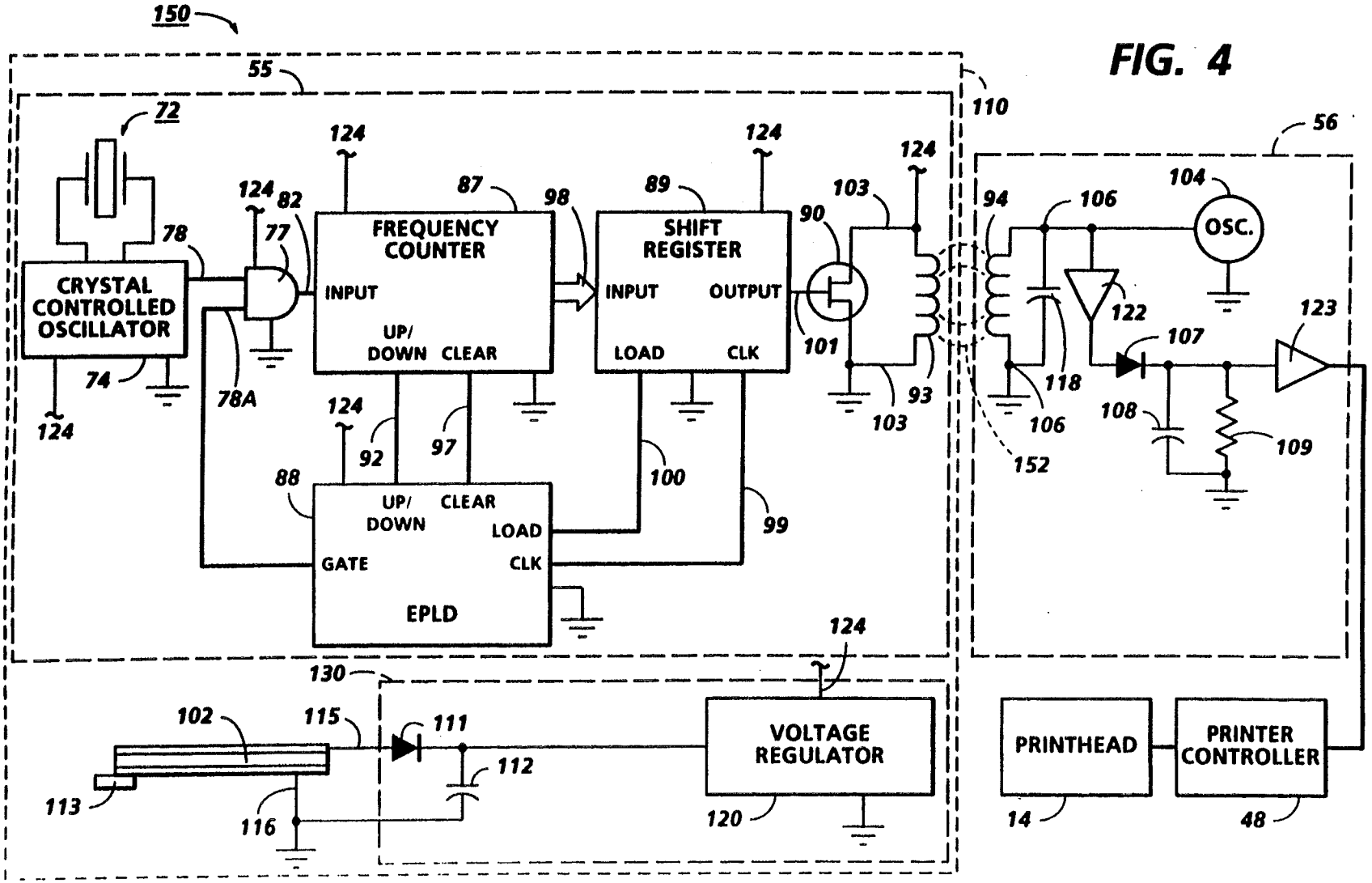
FIG. 4 is a schematic diagram of the physical apparatus employing the electronic circuitry of the present invention shown in FIG. 2.
Figure 5:
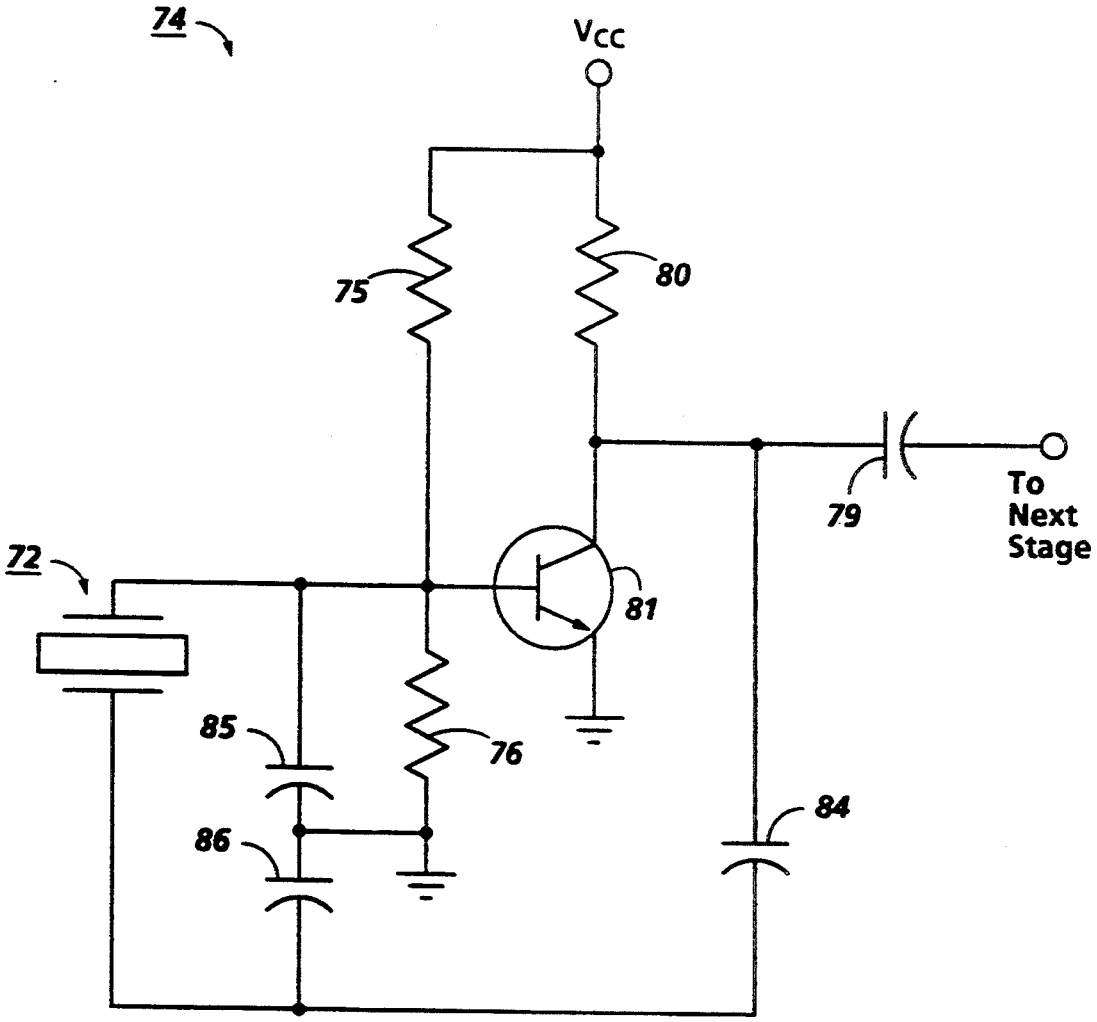
FIG. 5 is a detailed circuit diagram of the electronic oscillator shown in FIG. 4.

As shown in FIGS. 4 and 5, the crystal plate 72 forms part of a conventional crystal-controlled oscillator circuit 74 that is mounted on a 1½ inch by 1 inch printed wiring board assembly (PWBA) 73. The PWBA is located inside cavity 18 as illustrated in FIGS. 2 and 3. The crystal plate 72 is arranged so that ink drops can be deposited upon it. Referring specifically to FIG. 3, a layer of sticky substance 28, for example, such as a non-drying adhesive similar to that used on an adhesive tape is fixed around the interior periphery of the cavity 18 to prevent foreign material from falling around the inside of the platen interior, but instead adhere to the sticky substance. If moisture and/or other entrained contaminants is considered a problem, air could optionally be withdrawn from or filtered air blown into the interior of the platen by, for example, small passageways (not shown) in the shaft 13A. Heat also may be optionally directed to the interior of the platen by the shaft passageways or separate internal heaters (not shown) so as to more speedily evaporate the water content of the ink droplets. The evaporation subsequently disposes of the increased mass placed upon the crystal plate 72 by the ink droplets and does not affect the accuracy of the measurement. A total drop count of 50 milligrams$\times 0.01/10^{-7}$ grams or 5000 drops is equal to a 1% change in mass of the crystal plate. A mass increase of 1% will not cause the crystal plate to cease oscillation. Since 90% of an ink droplet is water, the water evaporates away and the accumulated drop count can exceed 50,000 drops because evaporation reduces the additional mass deposited on the crystal face by a factor of 90%. The accuracy of the measurement is controlled as discussed later on.

Referring to FIG. 5, the circuit comprising crystal plate 72 and oscillator 74 is a closed loop system composed of an amplifier 81 and a feedback network containing the crystal plate 72 and capacitor 84 discussed in more detail later. For an ordinary piece of quartz, in which molecules are randomly arranged, physical pressure will move the molecules to new positions in a random manner, and no net change in electric charge between opposite sides occur. In crystalline quartz, however, molecules and atoms are arranged in exact symmetry, and, if physical pressure is applied which causes deformation along a mechanical axis, an electric charge will be observed between faces which are along an electrical axis. Conversely, if a voltage is applied to these faces, a physical deformation along the mechanical axis will occur. This is known as the piezoelectric effect. Quartz plates ordinarily vibrate in synchronism with the frequency of an applied voltage. They will vibrate at a vastly increased amplitude when the applied frequency corresponds with the natural mechanical resonant frequency of the plate. Thus, crystal-controlled oscillators oscillate at a mechanically resonant frequency or its multiples thereof called overtones. In the operation of a crystal-controlled oscillator, the amplitude of oscillation builds up to the point where circuit non linearity decrease the loop gain to unity. The frequency of oscillation adjusts itself so that the total phase shift around the loop is 0 or 360 degrees. The crystal plate, which has a large reactance-frequency slope, is located in the feedback network where it has the maximum influence on the frequency of oscillation. The crystal-controlled oscillator is unique in that the impedance of the crystal plate changes so rapidly with frequency that all other circuit components are considered to be of a constant reactance at a frequency equal to the natural mechanical resonant frequency of the crystal plate. The frequency of oscillation will adjust itself so that the crystal plate presents a reactance to the circuit which will satisfy the phase requirement.

The crystal-controlled oscillator 74 of the present invention is shown in FIG. 5 in schematic form. The circuit is that of a transistorized Pierce-type, crystal-controlled oscillator where the A.C. ground is at the emitter of amplifier transistor 81. Resistors 75 and 76 are base-biasing resistors that supply a fixed bias for easy starting of oscillation. Capacitors 85 and 86 provide a phase shift network. Capacitor 84 and crystal plate 72 form the feedback loop. The values for capacitors 85 and 86 are selected to effectively swamp out the transistor output and input impedances as well as to provide feedback amplitude control by reducing the amplitude of the feedback so that it is not excessive. The phase shift through the transistor is 180 degrees and the total phase shift around the amplifier feedback loop is 0 or 360 degrees. The condition of a loop with unity gain is also provided by the capacitive voltage divider formed by the ratio of the values of capacitor 86 and capacitor 85. The oscillator output signal is taken across resistor 80 and coupled to the next stage by capacitor 79. Values and type designation for circuit elements are given in Table I below.

| Reference Nos. | Component Type | Value |
|---|---|---|
| 72 | Crystal | 10 Mhz. |
| 75 | Resistor | 470 Kohm |
| 76 | Resistor | 50 Kohm |
| 79, 84 | Capacitor | 1000 pfd |
| 80, 109 | Resistor | 5 Kohm |
| 81 | Transistor | 2N3904 |
| 85 | Capacitor | 39 pfd |
| 86 | Capacitor | 10 pfd |
| 90 | Transistor | MPF102 |
| 93 | Coil | 1 mh., 10 turns, ¾ in. dia. |
| 111 | Diode | 1N4148 |
| 112 | Capacitor | 1.0 mfd |
| 114 | Variable Capacitor | 0–25 pfd |
| 94 | Coil | 1.5 mh., 10 turns, ½ in. dia. |
| 106, 110 | Op Amp | LF357 |
| 107 | Diode | 1N4148 |
| 108 | Capacitor | .01 mfd. |

FIG. 4 illustrates electronic circuitry 150 for measuring the mass of the ink droplets ejected from a linear array of printhead nozzles. The electronic circuitry includes a transmitter subsystem 55 and a receiver subsystem 56. Transmitter subsystem 55 consists of: crystal plate 72 and crystal-controlled oscillator 74; a 2-input AND gate 77; a frequency counter 87; a shift register 89; an electronically programmable logic device (EPLD) 88; an output field effect transistor 90; and a coupling coil 93. With the exception of the coupling coil 93, all other components comprising the transmitter subsystem 55 are mounted, utilizing surface mount technology to the PWBA 73 located inside the platen 16 illustrated in FIGS. 2 and 3. The transmitter subsystem 55 generates a transmission signal responsive to the output of the frequency counter 87. Frequency counter 87 is used to measure changes in frequency which are directly proportional to the changes in mass caused by ink droplets deposited on the crystal face. The output from the crystal-controlled oscillator 74 is provided to the frequency counter in the following manner: A wire 78 interconnects the output of the crystal oscillator to one input of the 2-input AND gate 77. The output of the AND gate is applied the input of frequency counter 87 via a wire 82. The remaining input of the 2-input AND gate 77 is connected to the GATE output of the EPLD 88 by a wire 78A. AND gate 77 allows some pulses for each cycle of the input frequency, to pass through to the counter and then close, preventing other pulses from entering. A counter GATE signal from the EPLD 88 is applied to one input and the pulse train of the unknown frequency at the other. When both signals are present at the inputs of the AND gate, a signal identical to the pulse train of the unknown frequency will appear at the output of the AND gate. If either the pulse train or the counter GATE signal go away, there will be no output at the AND gate. Therefore, for every input pulse at the AND gate there is an identical pulse presented to the frequency counter at the output, but only during the time the counter Gate signal is present.

Figure 7:
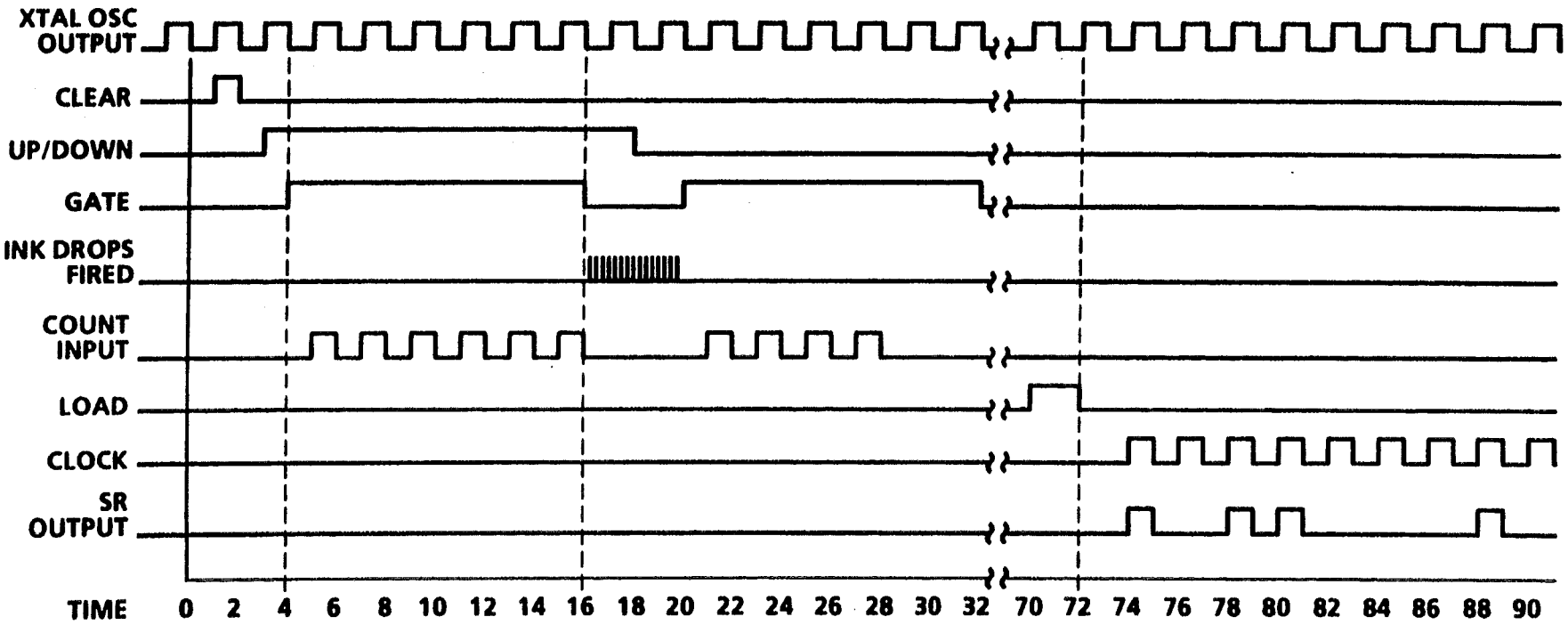
FIG. 7 is a timing diagram of the electronic circuitry of FIG. 4.

The frequency counter 87 is an up-down counter with a direct CLEAR capability. It can either count up or count down depending on the mode of its input. The up-down counter eliminates the problem of remeasuring an accumulation of residual ink droplets previously deposited on the crystal face. Ink droplets previously deposited are not detected when the oscillator frequency is measured before and after the firing of an ink jet. In actual operation, the frequency counter is triggered to perform a count-up sequence prior to depositing ink droplets on the crystal face and then triggered to perform a count-down sequence after the deposit so that the new measurement of frequency taken during the count-down sequence is representative of the change in mass for the new ink droplets deposited on the crystal face. Frequency counter 87 is controlled by the EPLD 88. The CLEAR input is an asynchronous input that causes the count output of the frequency counter to be in the logic low state of 0 whenever it is HIGH. The CLEAR input resets all the flip-flops (not shown) internal to the frequency counter 87. A CLEAR input to the frequency counter is applied from the EPLD through an interconnecting wire 97. The UP/DOWN input is yet another asynchronous input. When the UP/DOWN input is HIGH, the counter will increment on each pulse of the INPUT line. Similarly, when the UP/DOWN is LOW, the counter will decrement on each pulse of the INPUT line. An UP/DOWN signal to the frequency counter is applied from the EPLD through an interconnecting wire 92. The timing diagram of FIG. 7 has been prepared to illustrate the operation of frequency counter 87. Referring to FIG. 7, there is shown a continuous train of pulses labeled XTAL OSC OUTPUT which represent one pulse for each cycle of input frequency fed to one input of the AND gate circuit 86. As illustrated, the XTAL OSC OUTPUT signal has been squared up by a conventional input wave-shaping circuit (not shown). The output count (not shown) is undetermined until TIME=1, when the leading edge of the CLEAR pulse resets all the internal flip-flops (not shown) to 0. At TIME=3, the UP/DOWN line is set HIGH. A gate signal, GATE is set HIGH at TIME=4 and is applied to the other input of AND gate circuit 77. During the interval from TIME=5 to TIME=16, some of the XTAL OSC. OUTPUT pulses are transferred from the AND gate circuit 77 to the INPUT of frequency counter 87. The positive transitions of these pulses increment the counter to an initial value (not shown) that occurs at TIME=16 when the gate signal, GATE is reset LOW preventing any further pulses from passing through AND gate circuit 77. For the interval of time between TIME=16 and TIME=20 ink droplets are deposited on the crystal plate 72. The UP/DOWN line is pulled LOW at TIME=18. At TIME=20, the GATE is set HIGH. This set of input conditions cause some of the XTAL OSC OUTPUT pulses to again transfer from the AND gate 77 to the INPUT of frequency counter 87 until TIME=32 when the gate signal, GATE is again reset LOW preventing further pulses from passing through. However, during this gate period the positive transitions of the pulses decrement the counter to a final value (not shown). Since there has been an amount of mass added to the crystal plate, there is a proportional change in frequency as indicated by a new value at the output of the frequency counter.

The output of frequency counter 87, as shown in FIG. 4, is a binary number which is presented to the input of the shift register 89 on a data bus 98. The shift register is composed of a group of internal flip-flops (not shown) connected so each flip-flop transfers its bit of information to the next flip-flop when a clock pulse occurs. There are two modes of operation for the shift register: a LOAD mode and a SHIFT mode. During the load mode, the shift register has the ability to parallel load data simultaneously from the data bus 98. In the shift mode, the shift register serially transfers the data to the right so that the binary number contained in the shift register is presented to the input of transistor 90. Shift Register 89 is controlled by the EPLD 88. The CLOCK input causes the register to shift data and the LOAD input controls the mode of operation. The CLOCK input is supplied by the EPLD through an interconnecting wire 99. In a similar fashion, a LOAD input is supplied by the EPLD through an interconnecting wire 100. The timing diagram of FIG. 7 illustrates the operation of the shift register.

Referring to FIG. 7, there is shown a pulse labeled LOAD at TIME=70. From TIME=70 to TIME=72, the shift register is in the LOAD mode as indicated by its HIGH logic state. During this period, the data present at the output of frequency counter 87 is transferred into the parallel inputs of the internal register flip-flops (not shown) comprising the shift register 89. The data loaded is equal to the new frequency of the drop mass measurement where, for example, the new frequency may be equal to 9,050,675 cycles per second. At TIME=72 the shift register returns to the shift mode as indicated by its LOW logic state on the LOAD input. The EPLD now sends out a burst of synchronous clock pulses labeled CLOCK from TIME=74 to TIME=90. The first shift clock occurs at TIME=74 and the data begins to form at the output labeled SR OUTPUT. With each succeeding CLOCK pulse, the data is serially shifted to the right through the shift register until the last bit of data reaches the output, SR OUTPUT at TIME=90.

Referring again to FIG. 4, the combination of the transistor 90 and the coupling coil 93 form a final output stage for the transmitter subsystem 55. The final stage transmits the signal generated by the frequency counter to the corresponding receiver subsystem 56. The signal is transmitted by a form of amplitude modulation whose carrier frequency is switched on and off. This form transmission of is known by those skilled in the art as interrupted continuous wave (ICW) or on-off keying. The coupling coil 93 is part of a resonant circuit comprising coil 94 and capacitor 118 employed in the receiver subsystem 56 which is discussed later. The natural resonant frequency of the coupling coil 93 is equal to, for example, 23 Mhz. which is the carrier frequency of the final stage of the transmitter subsystem 55 when the transistor 90 is in its conducting or ON state. Transistor 90 is a junction field effect transistor that is biased as a switch so that there is zero drain current when the input drive signal applied to the gate is cut off. The input drive signal from the shift register is supplied to the gate of transistor 90 through an interconnecting wire 101. The coupling coil 93 is connected across the output of the transistor 90 by an appropriate set of conductors 103. As the transistor is alternately keyed on and off by the output data from the shift register, there is a corresponding change in impedance across the coupling coil 93. Values and type designation for transistor 90 and the coupling coil 93 are given in Table I.

The receiver subsystem 56 is located outside the cavity 18 as illustrated in FIG. 2. Coils 93 and 94 are mounted exteriorly of platen 16 along the axis of shaft 13A between the end cap 13 and the pulley 33. Additionally, the coils 93 and 94 are insulated by air from the surface of the shaft 13A. The end-to-end spacing between the coils is shown as distance C, with the preferred distance being about 0.5 inches. Coil 93 is mounted to the transmitter subsystem 55 on PWBA 73 by wire leads 103 extended through holes 105 in the end cap 13 so as to rotate with the platen drum. Coil 94 is mounted to the receiver subsystem 56 by wire leads 106 and is geometrically fixed. The entire receiver subsystem 56 is shown in FIG. 4 where the receiver subsystem 56 is comprised of: a coil 94; a capacitor 118; an oscillator 104; a preamplifier 122; a semiconductor diode 107; a capacitor 108; a resistor 109; and a post-amplifier 123. Oscillator 104 is a LC oscillator that uses the inductance of coil 94 and capacitor 118 along with the inductance of coil 93 when transistor 90 is turned on as the frequency-determining components, coil 93 and coil 94 are mutually coupled by inductance field 152. The oscillator is a standard Colpitts-type oscillator that has a frequency of oscillation identical to the carrier frequency of the transmitter subsystem 55. The receiver subsystem 56 functions to detect the changes in impedance of the coupling coil 93. The change in impedance across the coupling coil 93, causes the resonant frequency of the combined components consisting of the coupling coil 93, coil 94, and the capacitor 118 to change. As the resonant frequency changes, the voltage drop across the coil 94 correspondingly changes to form a string of pulses whose total count is proportional to the ink drop mass. The voltage across coil 94 is amplified by preamplifier 122. The combination of semiconductor diode 107, capacitor 108, and resistor 109 form a standard demodulation stage to recover from the modulated sine wave a pulsating D.C. voltage that varies in accordance with the modulation present on the wave. Thus, diode 107 rectifies the modulated wave. Capacitor 108 is a small value capacitor and resistor 109 is a relatively high resistance so that the combination of capacitor 108 and resistor 109 form the load impedance across which the rectified output voltage of the diode 107 is developed. At each positive peak of the radio-frequency cycle, the capacitor 108 charges up to a potential that is substantially equal to the peak of the applied voltage. Between peaks, some of the charge on the capacitor 108 leaks off through resistor 109, to be replenished by an appropriate new charge at the peak of the next radio-frequency cycle. The result of this situation is that the voltage developed across the load impedance of capacitor 108 and resistor 109 varies in accordance with the input to reproduce the modulation envelop of the applied signal. The current that flows through the diode is in the form of pulses occurring at the peak of the radio-frequency cycle. The pulses assume whatever amplitude is necessary to charge capacitor 108 up to a voltage that is substantially equal to the the peak of the applied radio-frequency voltage. The average value of the pulses of current flowing through the diode 107, that is, the rectified current, is a pulsating direct current. The output voltage is the voltage that the rectified current produces across the load impedance when flowing through the impedance formed by capacitor 108 and resistor 109 in parallel. The recovered pulsating D.C. voltage is presented to the input of the post-amplifier 123 so as to obtain an output of greater magnitude which is compatible with the printer controller 48. Values and type designation for the components comprising the receiver subsystem 56 are given in Table I.

As disclosed in U.S. Pat. No. 5,107,276, incorporated herein by reference, the operating temperature of the printhead is maintained constant because the drop sizes or drop volumes vary with temperature. Since each ejected droplet by an electrical pulse adds a known amount of heat to the printhead, a lookup table was used to adjust the drop ejecting pulses based upon the number of droplets ejected. Other prior art techniques to maintain constant drop sizes involve monitoring the printhead temperature with a temperature sensor and adjusting the drop ejecting pulses in accordance with the sensor printhead temperature. In contrast, the droplet ejecting pulses of this invention periodically measures the mass of the droplets and compares this mass measurement with the desired mass. The printing controller adjusts the droplet ejecting electrical pulses in accordance with values in a lookup table based upon the measured drop mass.

Figure 6:
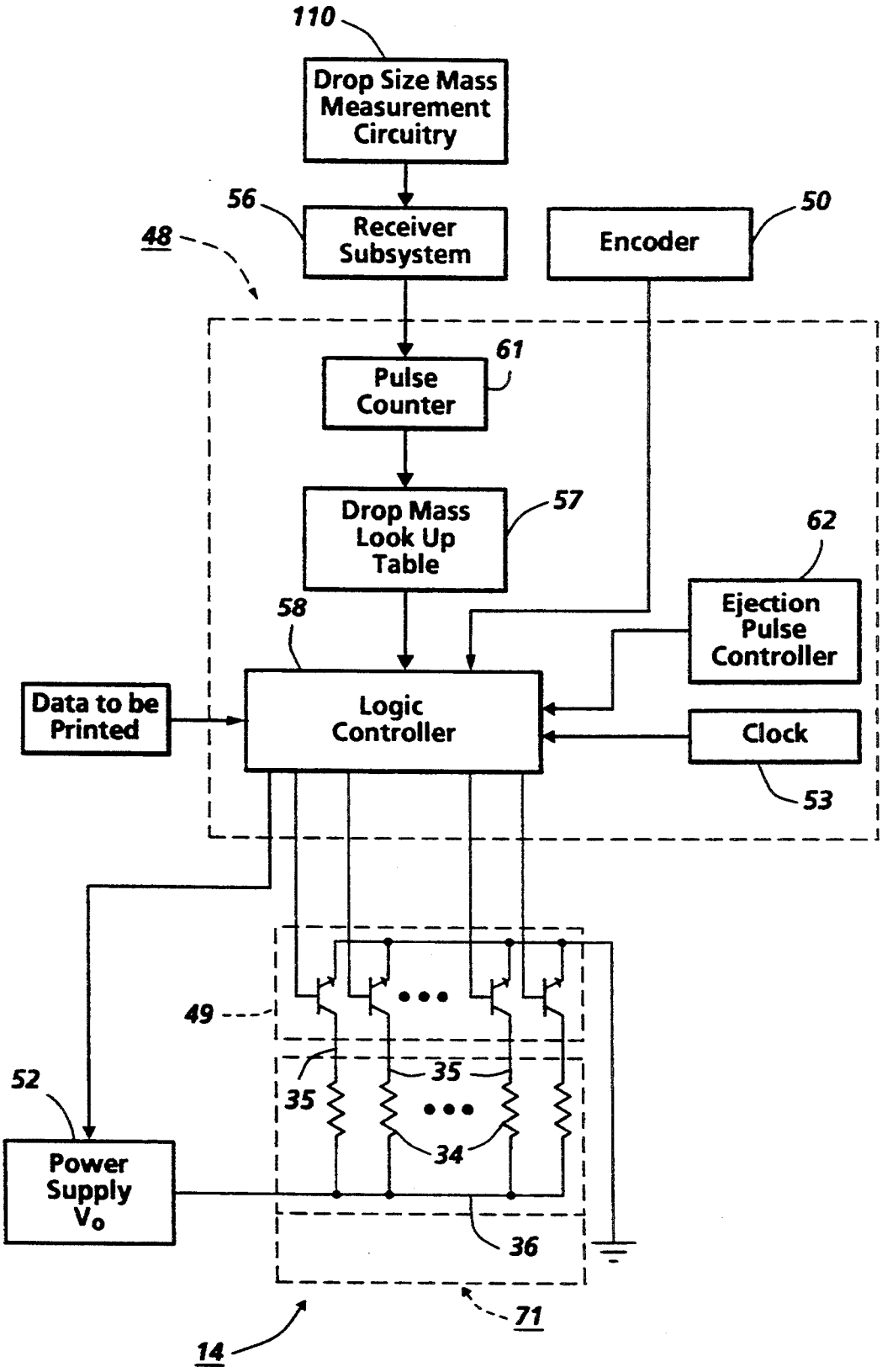
FIG. 6 is a schematic diagram of the control circuitry for the printer shown in FIG. 1, including the circuitry of FIG. 4.

In the preferred embodiment of FIG. 6, the logic controller 58 within the printer controller 48 receives data to be printed in the form of digitized date signals. The encoder 50 provides signals indicative of the location of the printheads 14, relative to the printing region "A" of FIG. 1, to the logic controller. The drop size mass measurement circuitry 110 sends measurement signals representative of the mass of the droplets to the receiver subsystem 56, in a manner discussed relative to FIG. 4, which in turn sends a series of pulses representative of the mass of droplets to a pulse counter 61. The pulse counter 61 sends a signal representative of the total pulse count received from the receiver subsystem to the drop mass lookup table which accepts the total count signal and compares the total pulse, a representation of the mass measurement, with the desired mass measurement, then submits signals to the logic controller to modify the pulse width AND AMPLITUDE given by the ejection pulse controller 62 to the heating elements 34 in the printheads 14. The power supply 52 provides a VARIABLE voltage $V_o$ to the common bus 36 and the heating elements are pulsed within this voltage through drivers 49 with one connected to the printhead addressing electrodes 35 and to ground. Thus, the electrical pulses applied to the heating elements or resistors 34 have a VARIABLE amplitude and width to eject a droplet. Clock 53 provides the TIMING for the logic controller 58. Accordingly, the droplet size or volume is maintained constant based upon the actual droplet volumes measured, instead of by using printhead temperature, measures directly or indirectly to adjust the droplet ejecting pulses applied to the heating elements.

Referring to FIG. 6, the printer controller 48 contains a look up table 57 which receives input signals representative of the drop size mass measurement from the drop size mass measurement circuitry 110. Based upon the mass size of the ink droplet, the subthreshold pulse width controller 56 signals the logic controller 58 to adjust heat generating electrical pulses sufficient to eject constant volume droplets.

FIG. 2 and FIG. 4 illustrate the method of electrically powering the transmitter subsystem 55 which is located inside the rotating platen. As shown in FIG. 2 a transducer 102 is also located inside the rotating platen drum and fixed to the shaft 13A that turns the rotatable platen. The transducer 102 is a vibrating strip of piezoelectric ceramic material such as, for example, a modified lead zirconate titanate (PZT) composition. Attached to the other end of the transducer 102 is a freely suspended weight 113. As the shaft 33 rotates, the bending moments indicated by the bi-directional arrow 114 and caused by the freely suspended weight 113 deflect the transducer 102 so that an electromotive force (EMF) is generated. The amount of EMF so obtained is proportional to the amplitude of the deflection multiplied by the frequency of rotation squared. However, the EMF generated is not a steady nonfluctuating voltage. Subsequently, the A.C. voltage is presented to the PWBA 73 by a set of interconnecting wires 115 and 116 for rectification, filtering, and regulation.

Referring specifically to FIG. 4, the interconnecting wires 115 and 116 attach the output the transducer 102 to the input of a power supply 130. The power supply 130 is comprised of a half-wave rectifier diode 111, a filter capacitor 112, and a voltage regulator 120. In operation, the diode 111 conducts each time its anode goes positive. When the anode goes negative, the diode 111 cuts off, and, except for a slight leakage current, there is no output. The output is therefor a pulsating D.C. voltage equal to the peak amplitude of the A.C. voltage generated by the transducer 102. The output of rectifier diode 111 is filtered by a capacitor input filter 112. The filter capacitor 112 charges to the peak value of the A.C. input voltage. When the input voltage begins to decrease below the voltage across the capacitor, then the capacitor begins to discharge through the input resistance of the voltage regulator 120 connected to the capacitor. The capacitor discharge current that flows through the load resistance of the voltage regulator prevents the voltage from dropping to zero, as it normally would without the presence of the capacitor. Load regulation is provided by connecting the filter capacitor 112 to a voltage regulator 120. The voltage regulator 120 provides a constant voltage to the transmitter subsystem 55 despite deviations in the output voltage across the capacitor 112. Thus a DC voltage is applied to the appropriate components in the transmitter subsystem from the output of the voltage regulator via a power bus 124 as illustrated in FIG. 4. Values and type designation for diode 111, capacitor 112, and voltage regulator 120 are given in Table I.

In recapitulation, it is clear that the present invention relates an ink jet printer having a resonant vibratory device to measure the mass of the ink droplets ejected from the printhead nozzles. A rotatable platen with an oscillator circuit mounted therein has a quartz crystal on which ink droplets are deposited. The difference in frequency before and after deposition is proportional to the ink drop mass. Changes in drop mass are controlled by printer controller varying the droplet ejecting pulses to the heating elements is the printhead in response to input from the mass measurement circuitry 110 and lookup table 57. This provides a control of the spot size.

It is, therefore, evident that there has been provided in accordance with the present invention, a drop size mass measurement system that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. A thermal ink jet printer for ejecting and propelling ink droplets from a printhead onto a recording medium in response to digitized image data signals, the printhead having means for measuring and controlling the mass of the ink droplets, said measuring and controlling means comprising:

a resonant vibrating device having a surface positioned in the path of the ejected ink droplets whereby said droplets are deposited onto, and adhere to, said surface;

means for measuring the frequency of said vibrating device and for generating an output signal representing the mass of the deposited droplets;

means for comparing the output signal to a desired mass value and for generating a comparison signal; and a controller for adjusting driving pulses to the printhead in response to the comparison signal to maintain the mass of the ejected ink droplets at the desired mass value.

2. The printer of claim 1 wherein said resonant vibrating device is a piezoelectric sensor having a predetermined mass and a surface for receiving a predetermined plurality of the droplets, each droplet having a mass, the sensor being driven by a controlled oscillator, the controlled oscillator having a frequency dependent upon the mass of the piezoelectric sensor.

3. The printer of claim 2 wherein said means for measuring the frequency of said sensor includes:

transmitter circuitry including a frequency counter for measuring the oscillator frequency before and after said plurality of ink droplets are received on the piezoelectric sensor surface, the frequency counter generating an output signal for each measured frequency;

a resonant circuit having first and second coils, the first coil receiving and transmitting the output signal generated by the frequency counter to the second coil; and a receiver subsystem connected to the second coil of the resonant circuit to detect voltage changes in the second coil, said changes being proportional to the mass of the ink droplets received on the sensor surface.

4. The printer of claim 1 wherein the means for comparing the output signal to a desired mass value includes a lookup table.

5. A method of controlling the mass of ink droplets ejected from an ink jet printhead comprising the steps of:

directing a plurality of ink droplets onto the surface of a resonant vibrating device;

measuring the frequency of said vibrating device and generating an output signal representing the mass of said deposited droplets;

comparing the generated output signal to a desired mass value and generating a comparison signal;

selectively applying driving pulses to the printhead representative of digitized data to eject droplets from the printhead in response thereto; and adjusting the driving pulses in response to the comparison signal, so that the mass of the ejected ink droplets are maintained constant.

6. A method of maintaining the mass of ink droplets ejected from an ink jet printhead, comprising the steps of:

converting the mass of a predetermined plurality of ink droplets to a change in mass of a quartz crystal plate;

generating an oscillator output voltage in response to the change in mass of said quartz crystal plate, the generated oscillator output voltage being representative of the mass of the droplets;

comparing said oscillator output voltage in response to the change in mass of the crystal plate to a stored mass value and generating droplet ejecting electrical pulses in accordance with said stored mass value;

selectively applying driving pulses to the printhead representative of said droplet ejecting electrical pulses to eject droplets in response thereto; and adjusting pulse width and amplitude of an ejection pulse controller in response to the droplet ejecting electrical pulses, so that the mass of the ejected ink droplets are maintained constant.

* * * * *